US010925365B2

(12) United States Patent
Jandali

(10) Patent No.: US 10,925,365 B2
(45) Date of Patent: Feb. 23, 2021

(54) TOTEBAG

(71) Applicant: Amer Jandali, New York, NY (US)

(72) Inventor: Amer Jandali, New York, NY (US)

( * ) Notice: Subject to any disclaimer, the term of this patent is extended or adjusted under 35 U.S.C. 154(b) by 0 days.

(21) Appl. No.: 16/743,575

(22) Filed: Jan. 15, 2020

(65) Prior Publication Data

US 2020/0146407 A1 May 14, 2020

Related U.S. Application Data

(63) Continuation-in-part of application No. 16/023,550, filed on Jun. 29, 2018, now abandoned.

(51) Int. Cl.

| | |
|---|---|
| ***A45C 3/04*** | (2006.01) |
| ***A45C 9/00*** | (2006.01) |
| ***A45C 7/00*** | (2006.01) |
| *A44C 5/00* | (2006.01) |

(52) U.S. Cl.

CPC ..... *A45C 9/00* (2013.01); *A45C 3/04* (2013.01); *A45C 7/0077* (2013.01); *A44C 5/003* (2013.01)

(58) Field of Classification Search

CPC ..... A45C 15/00; A45C 7/0077; A45C 3/04; A45C 9/00; A45F 2005/006; A45F 3/02; A45F 2005/008; A45F 4/02; A45F 2004/006; A45F 3/14; A45F 2003/142; A44B 11/006; A41D 15/04

USPC ..... 224/575, 577, 586, 219, 222

See application file for complete search history.

(56) References Cited

U.S. PATENT DOCUMENTS

| | | | | |
|---|---|---|---|---|
| 3,322,176 | A * | 5/1967 | Geller | B65D 29/04 383/6 |
| 5,009,516 | A * | 4/1991 | Geeck | A45C 3/04 206/37.1 |
| 5,154,506 | A * | 10/1992 | Leard | F21L 15/14 224/222 |
| 5,727,500 | A * | 3/1998 | Conboy | A01K 23/005 119/174 |
| 6,568,574 | B2 * | 5/2003 | Jones | A45C 1/04 224/219 |
| 2002/0084295 | A1 * | 7/2002 | Martindale | A45C 1/04 224/219 |
| 2008/0217369 | A1 * | 9/2008 | Sloot | A61F 5/0104 224/222 |
| 2008/0267540 | A1 * | 10/2008 | Ashworth | B65D 71/00 383/81 |
| 2015/0060504 | A1 * | 3/2015 | James | A45F 5/021 224/235 |

* cited by examiner

*Primary Examiner* — Adam J Waggenspack

(57) ABSTRACT

A totebag convertible into a wearable accessory for storage and transport having a flexible totebag that connects to a flexible linear outer sleeve. The flexible linear outer sleeve transitions longitudinally relative to the length of the flexible totebag between a first position and a second position. In the first position, the flexible linear outer sleeve is fully expanded and envelopes the full length of the flexible totebag such that an open end of the flexible linear outer sleeve is adjacent a top portion of the flexible totebag. In the second position, the flexible linear outer sleeve is compressed near the bottom of the flexible totebag and the flexible totebag is fully exposed. In the first position the totebag is configured as a bracelet, a headband, belt or other wearable accessory.

17 Claims, 4 Drawing Sheets

TOTEBAG

CROSS-REFERENCE TO RELATED APPLICATIONS

The present application is a continuation-in-part of and claims priority to U.S. patent application Ser. No. 16/023,550, filed Jun. 29, 2018 which is incorporated by reference herein in its entirety for all purposes.

FIELD OF THE INVENTION

The present application is related generally to a totebag and more particularly to a reusable totebag that may be worn on a person's wrist, waist, head or body for storage, transport and portability when not deployed.

BACKGROUND OF THE INVENTION

Reusable bags are becoming more popular and desirable to be used with carrying groceries or other such items instead of disposable bags such as plastic or paper bags. The reduction in use of disposable bags is desired both in terms of costs in manufacturing as well as cost to the environment based on continuous use of finite resources. What is desired is a reusable totebag that can be conveniently worn by a user on their wrist in a low-profile and unobtrusive manner while providing ease of access and use of the reusable totebag when desired.

SUMMARY OF THE INVENTION

An embodiment of a reusable totebag bracelet comprises a flexible totebag having a bottom portion defining a containment portion and a top portion defining an opening providing access to the containment portion, a flexible linear outer sleeve with a closed end and an opposite open end, the flexible totebag enveloped within the flexible linear outer sleeve through the open end of the flexible linear outer sleeve and the bottom portion of the flexible totebag attached to an inner surface of the flexible linear outer sleeve at the closed end, and the flexible linear outer sleeve configured to transition longitudinally relative to the flexible totebag between a first position where the flexible linear outer sleeve is fully expanded and envelopes a majority of the flexible totebag and a second position where the flexible linear outer sleeve is compressed near the closed end portion and the flexible totebag is fully exposed.

In an exemplary embodiment, a plurality of handles are attached to a periphery of the opening of the flexible totebag. The flexible linear outer sleeve has a cylindrical shape. The flexible linear outer sleeve is constructed with a first material and the flexible totebag is constructed with a second material. In an exemplary embodiment of the reusable totebag bracelet, the flexible linear outer sleeve is water repellent.

In an exemplary embodiment, a fastener strap is attached to an outer surface of the flexible linear outer sleeve proximate the open end. A first connector is attached to the fastener strap, a second connector is attached to the outer surface of the flexible linear outer sleeve near a longitudinal midpoint of the flexible linear outer sleeve, and a fastening loop is attached to the outer surface of the flexible linear outer sleeve proximate the closed end. The fastener strap is configured to pass through the fastener loop and the first connector configured to cooperatively engage with the second connector to form a bracelet.

In an exemplary embodiment, the fastener strap is made of an elastic material. The first connector and the second connector are hook and loop connectors. The opening of the flexible totebag includes a means of securing the opening. The bottom portion of the flexible totebag is permanently connected to an inner surface of the flexible linear outer sleeve at the closed end. The bottom portion of the flexible totebag is removably connected to an inner surface of the flexible linear outer sleeve at the closed end.

In an exemplary embodiment, a fastener strap is attached to an outer surface of the flexible linear outer sleeve proximate the closed end, a first connector is attached to the fastener strap, a second connector is attached to the outer surface of the flexible linear outer sleeve near a longitudinal midpoint of the flexible linear outer sleeve, and a fastening loop is attached to the outer surface of the flexible linear outer sleeve proximate the open end. The fastener strap is configured to pass through the fastener loop and the first connector is configured to cooperatively engage with the second connector to form a bracelet.

In an exemplary embodiment, a first connector is attached to an outer surface of the flexible linear outer sleeve proximate the closed end, a second connector is attached to the outer surface of the flexible linear outer sleeve near a longitudinal midpoint of the flexible linear outer sleeve, and a fastening loop is attached to the outer surface of the flexible linear outer sleeve proximate the open end. The fastener strap is configured to pass through the fastener loop and the first connector is configured to cooperatively engage with the second connector to form a bracelet.

In an exemplary embodiment, a first connector is attached to an outer surface of the flexible linear outer sleeve proximate the open end, a second connector is attached to the outer surface of the flexible linear outer sleeve near a longitudinal midpoint of the flexible linear outer sleeve, and a fastening loop is attached to the outer surface of the flexible linear outer sleeve proximate the closed end. The fastener strap is configured to pass through the fastener loop and the first connector is configured to cooperatively engage with the second connector to form a bracelet.

A totebag convertible into a wearable accessory for storage and transport having a flexible totebag connected a flexible linear outer sleeve is shown and described. In one embodiment, a bottom portion of the flexible totebag connects to an inner surface of the closed end of the flexible linear outer sleeve. In another embodiment, the totebag is permanently connected to an inner surface of the sleeve at the closed end. In yet another embodiment, the totebag is removeably connected to an inner surface of the sleeve.

The flexible totebag has a bottom portion defining a containment portion and a top portion defining an opening providing access to the containment portion. The flexible linear outer sleeve has a closed end and an opposite open end. The flexible linear outer sleeve is dimensioned and configured to transition longitudinally relative to a length of the flexible totebag between a first position and a second position.

In the first position, the flexible linear outer sleeve is fully expanded and envelopes the full length of the flexible totebag and the open end of the flexible linear outer sleeve is disposed adjacent the top portion of the flexible totebag and the closed end of the flexible linear outer sleeve is disposed adjacent the bottom portion of the flexible totebag. In this first position, the linear sleeve has a cylindrical and slim shape. Furthermore, in the first position, the closed end and the opposite open end of the flexible linear outer sleeve are releasably connectable forming a wearable accessory.

For instance, the closed and open ends may be tied together to form a bracelet, a headband a belt or other wearable accessory.

The flexible totebag may exit the flexible linear outer sleeve through a window disposed adjacent the open end to realize the second position. In the second position, the flexible linear outer sleeve is compressed near the bottom portion of the flexible totebag, the open end of the flexible linear outer sleeve is disposed adjacent the bottom portion of the flexible totebag and the flexible totebag is fully exposed. The flexible totebag has a length from the top portion and the bottom portion such that the full, unfolded, length of the totebag is retained in the flexible linear outer sleeve in the first position. Said length may be an unfolded, longitudinal length in one embodiment, in another embodiment the length may be an unfolded, latitudinal length and yet in another embodiment, the length may be an unfolded diagonal length of the totebag. A plurality of handles may be attached to a periphery of the opening of the flexible totebag.

A fastener strap may be attached to an outer surface of the flexible linear outer sleeve proximate a first end with a first connector attaching to the fastener strap and a second connector attaching to the outer surface of the flexible linear outer sleeve near a longitudinal midpoint of the flexible linear outer sleeve. A fastening loop attaches to the outer surface of the flexible linear outer sleeve proximate a second end such that the fastener strap is configured to pass through the fastener loop and the first connector is configured to cooperatively engage with the second connector forming a wearable accessory. In one embodiment, the first end is the open end and the second end is the closed end. In another embodiment, the first end is the closed end and the second end is the open end.

A totebag having a flexible totebag with a bottom portion defining a containment portion and a top portion defining an opening providing access to the containment portion and a flexible linear outer sleeve. The sleeve has a closed end and an opposite open end and has a length. The flexible linear outer sleeve is dimensioned and configured to transition longitudinally relative to a full length of the flexible totebag between a first position and a second position.

In the first position, the open end of the flexible linear outer sleeve is disposed adjacent the top portion of the flexible totebag the length of said flexible linear outer sleeve is sufficient to contain the full length of the flexible totebag, in an unfolded orientation. In the first position, the closed end and the opposite open end of the flexible linear outer sleeve are releasably connectable forming a wearable accessory as said flexible linear outer sleeve has a cylindrical and slim shape. The sleeve may have a length extending beyond the length of the totebag such that the ends of the sleeve are free to be tied together to form a bracelet, a headband, bandana, belt or other wearable accessory. In one embodiment, the length may be an unfolded, longitudinal length. In another embodiment, the length may be an unfolded, latitudinal length and yet in another embodiment, the length may be an unfolded diagonal length of the totebag.

In the second position, the open end of the flexible linear outer sleeve is disposed adjacent and compressed in an accordion-like configuration near the bottom portion of the flexible totebag with the flexible totebag being deployed. The bottom portion of the flexible totebag connects to an inner surface of the closed end of the flexible linear outer sleeve. The flexible totebag length is defined between said bottom portion to said top portion.

DETAILED DESCRIPTION OF THE INVENTION

Figure 1:
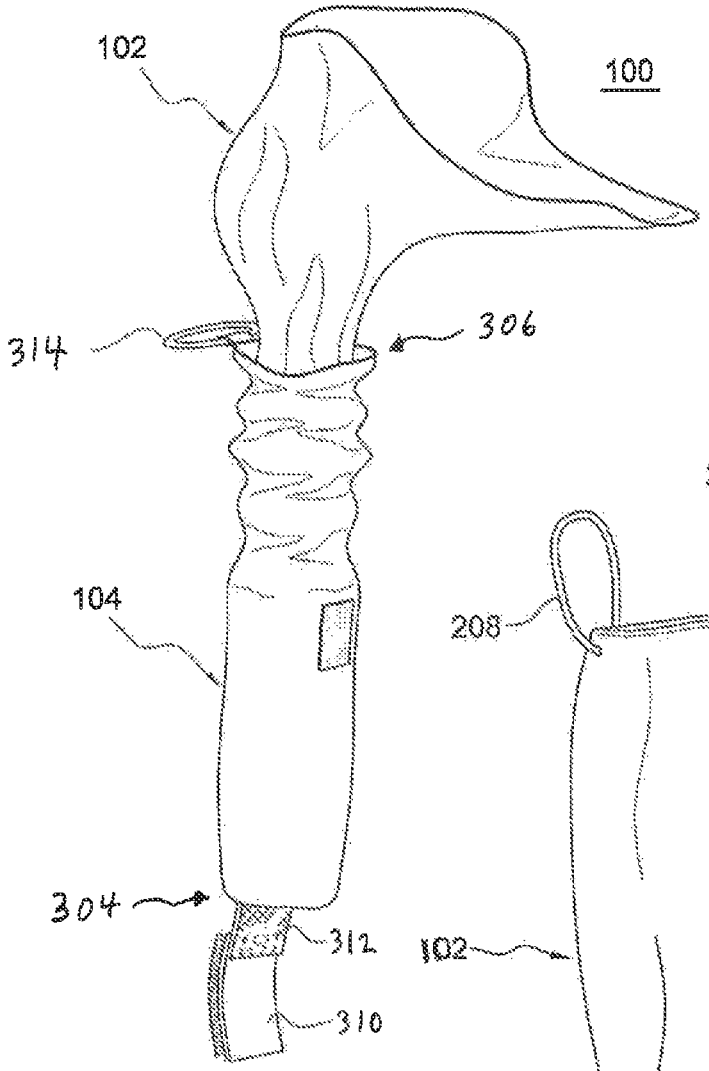
FIG. 1 illustrates a totebag convertible into a wearable accessory for storage and transport according to some embodiments.

In FIG. 1, a reusable totebag according to some embodiments is illustrated. As illustrated in FIG. 1, the reusable totebag 100 is comprised of a flexible totebag 102 enveloped within a flexible linear outer sleeve 104. The outer sleeve 104 may be collapsed or expanded relative to the totebag 102 thereby enveloping more or less of the totebag 102 within the outer sleeve.

Figure 2:
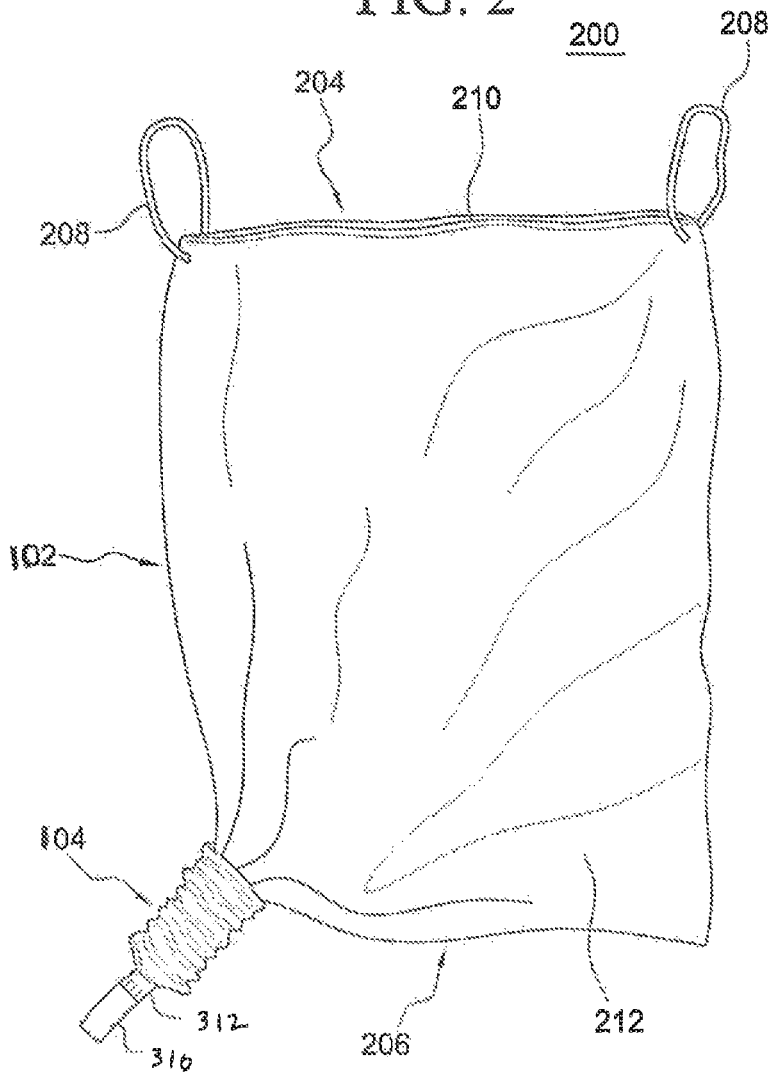
FIG. 2 illustrates the totebag with the flexible totebag fully deployed according to some embodiments.

In FIG. 2, a reusable totebag with the flexible totebag fully deployed according to some embodiments is illustrated. As illustrated in FIG. 2, the flexible linear outer sleeve 104 of the reusable totebag 200 has been sufficiently collapsed relative to the flexible totebag 102 as to allow totebag 102 to be fully deployed. Here the sleeve 104 is shown compressed in an accordion like manner near the bottom of the totebag 102. The totebag 102 includes at least a bottom portion 206 and a top portion 204. The bottom portion 206 defines a container portion 212 in which articles to be carried within the totebag 102 are placed. The top portion 204 defines an opening 210 that provides access to the container portion 212 within the totebag 102. The top portion 204 also includes a pair of handles 208, each handle attached to opposite ends of the opening 210.

The opening 210 may include a means of securing the opening as to protect the contents within the container portion 212 of the totebag 102 from the outside environment.

The totebag 102 may be made of any light and flexible material known to one ordinary skill in the art including plastic, polyethylene, polypropylene, or any practical microfiber type material, or the like. Moreover, the light and flexible material comprising the totebag 102 may be made of a single layer of material or from a combination of multiple layers of one or more materials.

Returning to FIG. 2, the totebag 102 is attached to the outer sleeve 104 at any point along the bottom portion 206 of the totebag 102. This may be either a permanent attachment or a removable attachment. A removable attachment allows for a variety of different types and sizes of totebag to be attached to and enveloped within the same outer sleeve.

Figure 3:
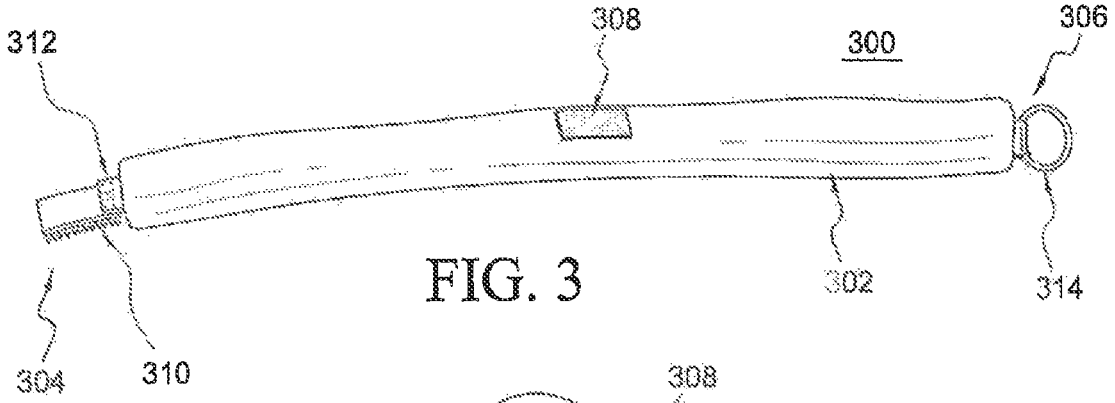
FIG. 3 illustrates the totebag in one orientation with the flexible totebag fully enveloped within the flexible linear outer sleeve according to some embodiments.

In FIG. 3, a reusable totebag bracelet with the flexible totebag fully enveloped with the flexible linear outer sleeve according to some embodiments is illustrated. As illustrated in FIG. 3, the outer sleeve includes a fastening strap 312 that is attached at one end to the closed end 304 of the outer sleeve 302. The fastening strap 312 is preferably made of an elastic material that allows for the reusable totebag bracelet to be worn comfortably on wrists of different sizes and shapes.

A first connector 310 is attached to the other end of the fastening strap 312 and a cooperating second connector 308 is attached to the outer surface of the outer sleeve 302 near a longitude midpoint of the outer sleeve 302. The first and second connectors 310 and 308 may be any low-profile type of connectors known to one of ordinary skill in the art including hook and loop fasteners, an example of which is Velcro® Brand fastener closure products made by the Velcro Companies.

A fastening loop 314 is attached to the outer surface of the outer sleeve 302 near the open end 306 of the outer sleeve 302, the fastening loop 314 defining an opening through which the fastening strap 312 and first connector 310 are passed to form a bracelet. The fastening loop 314 may be made from the same material as the outer sleeve or as a different material. The fastening loop 314 may also include an inner core covered by the same material as the outer sleeve, the inner core defining and maintaining an opening through which the fastening strap 312 and first connector 310 are passed.

As with the totebag 102, the outer sleeve 303 may be made of any light and flexible material known to one ordinary skill in the art including plastic, polyethylene, polypropylene, any practical microfiber type material, or the like. Moreover, the light and flexible material comprising the outer sleeve 302 may be made of a single layer of material or from a combination of multiple layers of one or more materials. Further, the material comprising the outer sleeve 302 may be constructed from a water repellent material or be treated with a water repellent treatment.

In another embodiment, the outer sleeve 302 is comprised of materials that provide greater protection from the surrounding environment than the materials comprising the totebag 102. As a result, the outer sleeve 302 might purposely be heavier and less flexible than the totebag 102 to which it is connected and which it envelopes.

Figure 4:
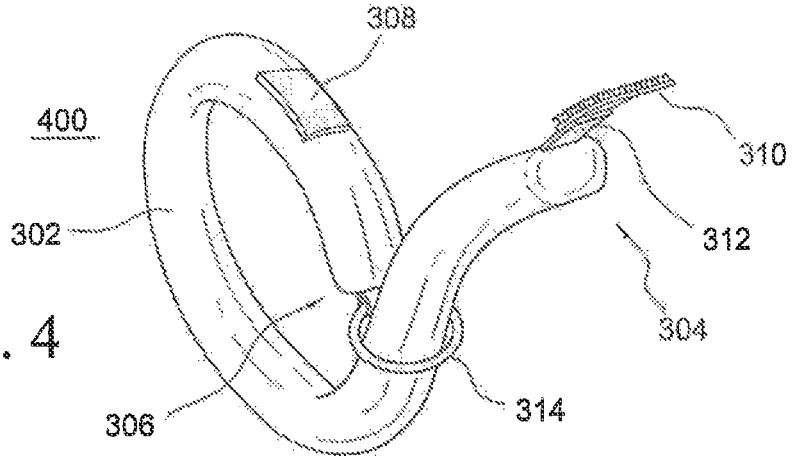
FIG. 4 illustrates the totebag in another orientation with the flexible totebag fully enveloped within the flexible linear outer sleeve according to some embodiments.

In FIG. 4, a reusable totebag bracelet with the flexible totebag configured as a bracelet according to some embodiments is illustrated. As illustrated in FIG. 4, with the totebag 102 fully enveloped within the outer sleeve 302, the first connector 310 and the fastening strap 312 are passed through the opening of the fastening loop 314. Once the first connector 310 and the fastening strap 312 have been passed through the opening of the fastening loop 314, a portion of the outer sleeve 312 starting at the closed end 304 is also pulled through the opening. The first connector 310 is then secured to the second connector 308 and a bracelet is formed. Once the bracelet is formed, the reusable totebag bracelet of the present invention may be secured on a person's wrist for storage and portability.

Figure 5:
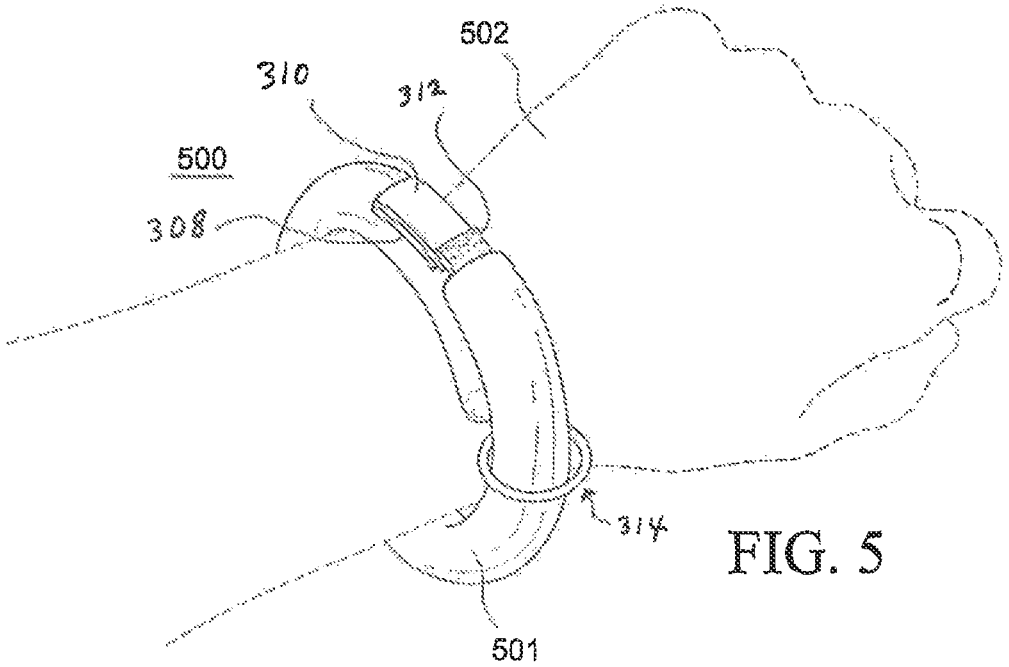
FIG. 5 illustrates the totebag fashioned into a wearable bracelet with the flexible totebag secured on a person's wrist according to some embodiments.

In FIG. 5, a reusable totebag bracelet with the flexible totebag secured on a person's wrist according to some embodiments is illustrated. As shown in FIG. 5, the flexible totebag is configured as a bracelet 501 around a person's wrist 502 and is worn as such until the totebag is to be deployed.

Figure 6:
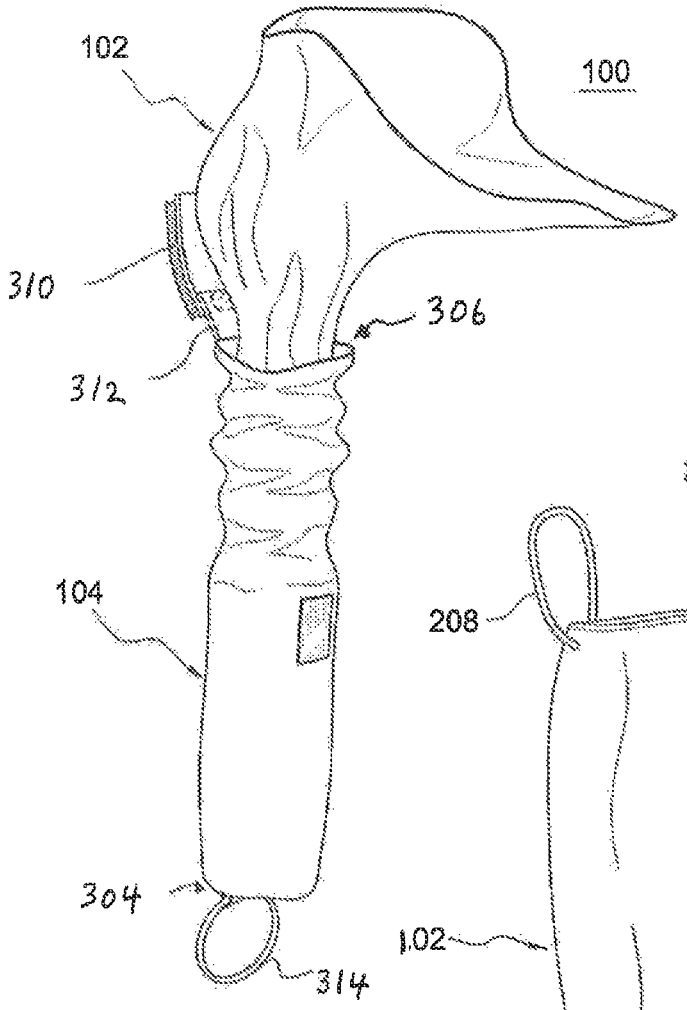
FIG. 6 illustrates the totebag according to some embodiments.

In FIG. 6, a reusable totebag bracelet according to some embodiments is illustrated. As illustrated in FIG. 6, the reusable totebag bracelet 100 is comprised of a flexible totebag 102 enveloped within a flexible linear outer sleeve 104, similar to FIG. 1. In this embodiment, the location of fastening strap 312 and fastening loop 314 are reversed as compared to the respective locations shown in FIG. 1. In the embodiment shown in FIG. 6, fastening strap 312 is attached to the outer surface near the open end 306 of the outer sleeve 302, and the fastening loop 314 is attached to the closed end 304 of the outer sleeve 302.

Figure 7:
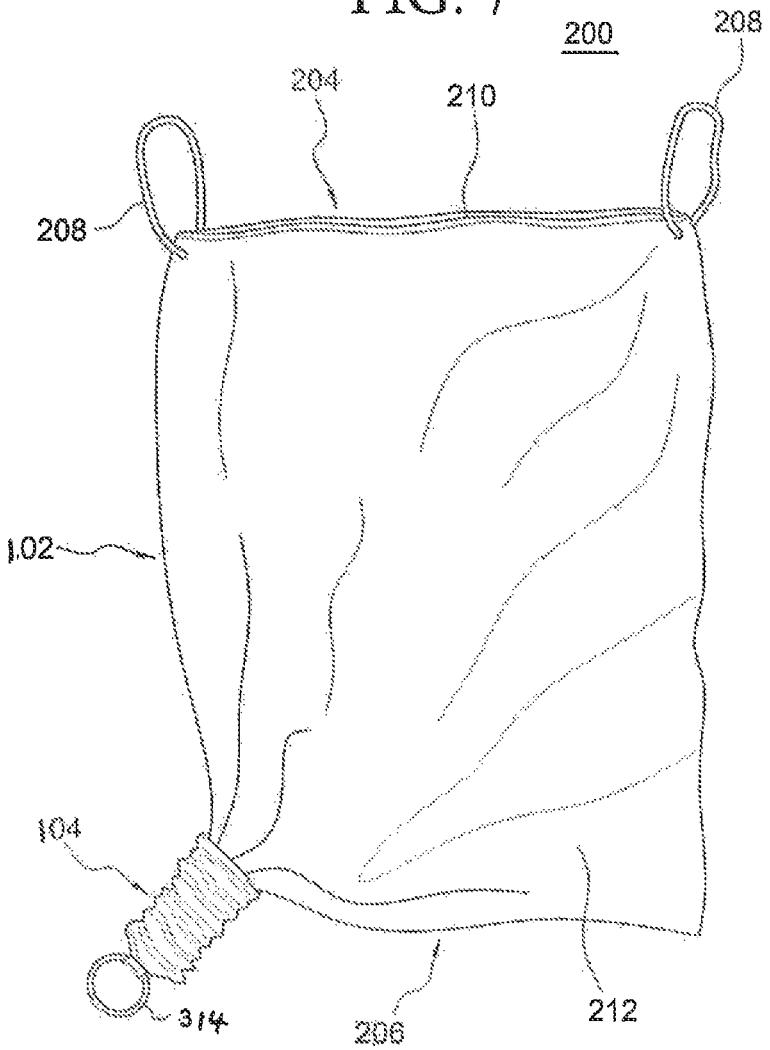
FIG. 7 illustrates the totebag bracelet with the flexible totebag fully deployed according to some embodiments.

In FIG. 7, a reusable totebag bracelet with the flexible totebag fully deployed according to some embodiments is illustrated. In this embodiment, the location of fastening strap 312 and fastening loop 314 are reversed as compared to the respective locations shown in FIG. 2. In the embodiment shown in FIG. 6, fastening strap 312 is attached to the outer surface near the open end 306 of the outer sleeve 302, and the fastening loop 314 is attached to the closed end 304 of the outer sleeve 302.

The formation of a bracelet for the reusable totebag bracelets as shown in FIGS. 6 and 7 is the same configuration as shown and described above with respect to FIG. 4 in the interaction between the fastening strap 312 and the fastening loop 314 and the first connector 310 and second connector 308.

Figure 8:
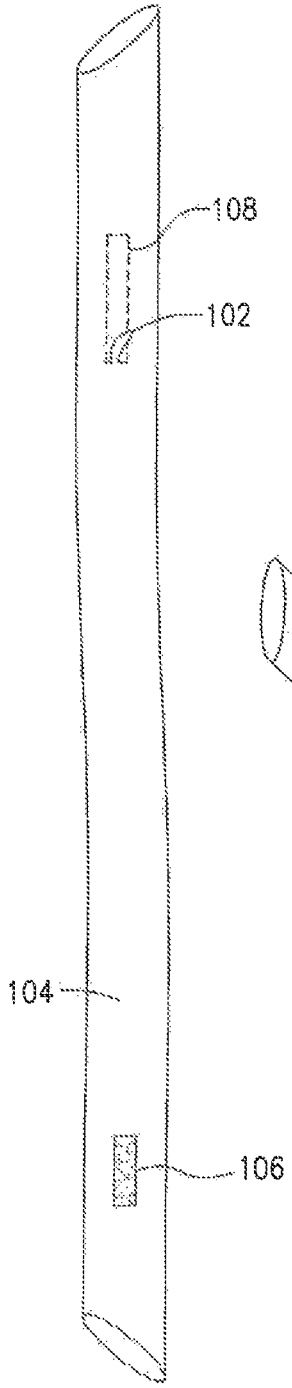
FIG. 8 shows the totebag with the flexible totebag fully enveloped within the flexible linear outer sleeve according to some embodiments
Figure 9:
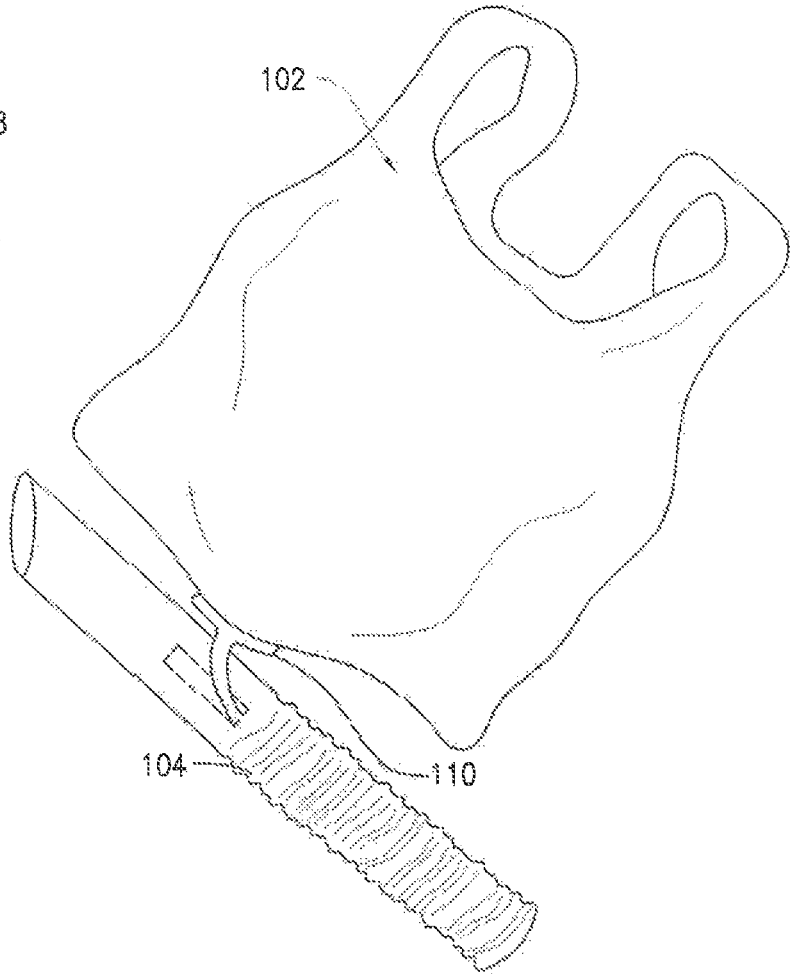
FIG. 9 shows the totebag with the flexible totebag deployed out of a window from the flexible linear outer sleeve according to some embodiments.

FIGS. 8 and 9 show the totebag convertible into a wearable accessory for storage and transport having a flexible totebag 102 connected a flexible linear outer sleeve 104. The sleeve 104 has a window 108 through which the totebag 102 is able to be deployed. The bottom portion of the totebag 102 is connected to the sleeve 104 via a connector 110. The connector 110 is permanently connects a bottom portion of the flexible totebag 102 to an inner surface of the closed end of the flexible linear outer sleeve 104. The connector 110 connects the totebag 102 to the sleeve on the inner surface on the sleeve 104 at connection point 106. In another embodiment, the totebag 102 is removeably connected to an inner surface of the sleeve 104.

The flexible totebag 102 has a bottom portion defining a containment portion and a top portion defining an opening providing access to the containment portion. The flexible linear outer sleeve 104 has a closed end and an opposite open end with a window 108 disposed at the open end. The sleeve 104 may have a length extending beyond the length of the totebag 102 such that the ends of the sleeve 104 are free to be tied together to form a bracelet, a headband, bandana, belt or other wearable accessory.

The flexible linear outer sleeve 104 is dimensioned and configured to transition longitudinally relative to a length of the flexible totebag 102 between a first position and a second position. In the first position, the flexible linear outer sleeve 104 is fully expanded and envelopes the length of the flexible totebag 102 and the open end of the flexible linear outer sleeve 104 is disposed adjacent the top portion of the flexible totebag 102 and the closed end of the flexible linear outer sleeve 104 is disposed adjacent the bottom portion of the flexible totebag 102. In this first position, the linear sleeve has a cylindrical and slim shape.

In the second position, the flexible linear outer sleeve 104 is compressed near the bottom portion of the flexible totebag 102. In FIG. 9 the sleeve 104 is compressed in an accordion-like configuration near the bottom portion of the flexible totebag 102 with the flexible totebag being deployed and fully exposed. The flexible totebag 102 has a length from the top portion and the bottom portion such that the full, unfolded longitudinal length of the totebag is retained in the flexible linear outer sleeve in the first position. See FIG. 8. In another embodiment the length may be an unfolded, latitudinal length and yet in another embodiment, the length may be an unfolded diagonal length of the totebag.

While specific embodiments of the invention have been described and illustrated, such embodiments should be considered illustrative of the invention only and not as limiting the invention as construed in accordance with the accompanying claims. One of ordinary skill in the art could alter the above embodiments or provide insubstantial changes that may be made without departing from the scope of the invention.

I claim:

1. A totebag convertible into a wearable accessory for storage and transport comprising:

a flexible totebag having a closed bottom portion defining a containment portion and a top portion defining an opening providing access to the containment portion;

a flexible linear outer sleeve with a closed end and an opposite open end, the flexible linear outer sleeve being dimensioned and configured to transition longitudinally relative to a length of the flexible totebag between a first position and a second position, wherein the bottom portion of the flexible totebag connects to an inner surface of the closed end of the flexible linear outer sleeve via a fastener;

wherein, in the first position, the flexible linear outer sleeve is fully expanded and envelopes the length of the flexible totebag and the open end of the flexible linear outer sleeve is disposed adjacent the top portion of the flexible totebag, and, in the second position, the flexible linear outer sleeve is compressed near the bottom portion of the flexible totebag and the flexible totebag is fully exposed a fastener strap attached to an outer surface of the flexible linear outer sleeve proximate a first end; a first connector attached to the fastener strap; a second connector attached to the outer surface of the flexible linear outer sleeve near a longitudinal midpoint of the flexible linear outer sleeve; and a fastening loop attached to the outer surface of the flexible linear outer sleeve proximate on a second end, the fastener strap configured to pass through the fastener loop and allow the first connector to cooperatively engage with the second connector to form a wearable accessory.

2. The totebag of claim 1, further comprising a plurality of handles attached to a periphery of the opening of the flexible totebag.

3. The totebag of claim 1, wherein the flexible linear outer sleeve has a cylindrical shape.

4. The totebag of claim 1, wherein the flexible linear outer sleeve has a slim shape.

5. The totebag of claim 1, wherein said flexible totebag length extends from said top portion to said bottom portion, wherein in the first position, said flexible totebag length is unfolded longitudinally.

6. The totebag of claim 1, wherein the bottom portion of the flexible totebag is permanently connected to the inner surface of the flexible linear outer sleeve at the closed end.

7. The totebag of claim 1, wherein the bottom portion of the flexible totebag is removably connected to the inner surface of the flexible linear outer sleeve at the closed end.

8. The totebag of claim 1, wherein the flexible totebag exits the flexible linear outer sleeve through a window disposed adjacent the open end.

9. The totebag of claim 1, wherein, in the first position, the closed end of the flexible linear outer sleeve is disposed adjacent the bottom portion of the flexible totebag.

10. The totebag of claim 1, wherein, in the second position, the open end of the flexible linear outer sleeve is disposed adjacent the bottom portion of the flexible totebag.

11. The totebag of claim 1 wherein the first end is the open end and the second end is the closed end.

12. The totebag of claim 1, wherein the first end is the closed end and the second end is the open end.

13. A totebag comprising:

a flexible totebag having a closed bottom portion defining a containment portion and a top portion defining an opening providing access to the containment portion;

a flexible linear outer sleeve with a closed end and an opposite open end, said flexible linear outer sleeve having a length, said flexible linear outer sleeve being dimensioned and configured to transition longitudinally relative to a length of the flexible totebag between a first position and a second position, wherein, in the first position, the open end of the flexible linear outer sleeve is disposed adjacent the top portion of the flexible totebag, wherein, in said first position, said length of said flexible linear outer sleeve is sufficient to contain the length of the flexible totebag, in an unfolded orientation, wherein, in the second position, the open end of the flexible linear outer sleeve is disposed adjacent the bottom portion of the flexible totebag, said flexible totebag being deployed, and wherein the bottom portion of the flexible totebag connects to an inner surface of the closed end of the flexible linear outer sleeve via a fastener; a fastener strap attached to an outer surface of the flexible linear outer sleeve proximate a first end; a first connector attached to the fastener strap; a second connector attached to the outer surface of the flexible linear outer sleeve near a longitudinal midpoint of the flexible linear outer sleeve; and a fastening loop attached to the outer surface of the flexible linear outer sleeve proximate on a second end, the fastener strap configured to pass through the fastener loop and allow the first connector to cooperatively engage with the second connector to form a wearable accessory.

14. The totebag of claim 13, wherein said flexible totebag length extends from said top portion to said bottom portion.

15. The totebag of claim 13, wherein the flexible linear outer sleeve has a cylindrical shape.

16. The totebag of claim 13, wherein the flexible linear outer sleeve has a slim shape.

17. The totebag of claim 13, wherein, in the second position, the flexible linear outer sleeve is compressed in an accordion-like configuration near the bottom portion.

* * * * *